United States Patent [19]

Yeaman, Sr.

[11] Patent Number: 4,671,451

[45] Date of Patent: Jun. 9, 1987

[54] SLEEVE PACKAGE HAVING REVERSE TUCKED TABS FOR HOLDING MULTIPLE ASEPTIC CARTONS

[75] Inventor: William E. Yeaman, Sr., Park Ridge, Ill.

[73] Assignee: Yeaman Packaging Group, Inc., Wheeling, Ill.

[21] Appl. No.: 773,794

[22] Filed: Sep. 9, 1985

[51] Int. Cl.[4] ..... B65D 75/06

[52] U.S. Cl. ..... 229/40; 206/431; 206/434

[58] Field of Search ..... 229/40; 206/427, 429, 206/431, 434; 220/400, 449, 468

[56] References Cited

U.S. PATENT DOCUMENTS

| | | | |
|---|---|---|---|
| 2,260,424 | 10/1941 | Waters | 229/27 |
| 2,571,833 | 10/1951 | Chidsey, Jr. | 206/434 |
| 2,675,264 | 4/1954 | Vanderlugt, Jr. | 206/431 |
| 2,684,759 | 7/1954 | Freeman | 206/434 |
| 2,911,096 | 11/1959 | Andre | 206/434 |
| 2,975,891 | 3/1961 | Stone | 206/434 |
| 2,986,272 | 5/1961 | Kruse | 206/431 |
| 3,223,233 | 12/1965 | Becker et al. | 229/40 |
| 3,249,284 | 5/1966 | Wood | 229/40 |
| 3,395,791 | 8/1968 | Graser | 229/40 |
| 3,411,264 | 11/1968 | Farquhar | 229/40 |
| 3,589,593 | 6/1971 | Weiss | 229/40 |
| 3,635,452 | 1/1972 | Helms | 229/40 |
| 3,670,879 | 6/1972 | Williard et al. | 206/431 |
| 3,680,691 | 8/1972 | Lock | 229/40 |
| 3,698,624 | 10/1972 | Stark | 229/23 R |
| 3,833,116 | 9/1974 | Howe | 206/431 |
| 3,892,348 | 7/1975 | Rohner | 229/23 R |
| 3,900,103 | 8/1975 | Day | 206/431 |
| 3,986,658 | 10/1976 | Arneson | 229/40 |
| 4,415,082 | 11/1983 | Martin | 206/431 |
| 4,441,611 | 4/1984 | Sommariva | 206/431 |
| 4,458,836 | 7/1984 | Wood | 229/40 |

*Primary Examiner*—William Price
*Assistant Examiner*—Gary E. Elkins
*Attorney, Agent, or Firm*—Charles F. Lind

[57] ABSTRACT

The disclosed sleeve package is suited for economically holding a multi-pack arrangement of aseptic paperboard cartons. The sleeve blank has main side, top and bottom panels successively hinged to one another, to be wrapped around the arranged cartons, with lapped inner and outer panels being secured together to provide an open-ended sleeve. The carton has an end closure wall, and a flap defined by an end closure seam being folded over to lie against the wall. The flap is open in the direction toward a broad face of the carton. A reverse tuck tab is formed on the inner of the lapped panels, being cut and hinged therefrom. In use, the tab is reverse tucked to underlie and/or interfit with the flap on the carton end closure, to hold the cartons in place in the sleeve package. Several embodiments are disclosed, for holding one row of the cartons in the sleeve package, for holding several adjacent rows of cartons in the sleeve package, and for having the cartons aligned with the broad face crosswise to the open ends of the sleeve and with the end cartons of the row(s) rotated so that the flaps open in opposite directions and toward the open ends of the sleeve. The disclosed sleeve package provides large uninterrupted exposed side and top panel areas for advertising display copy, and uses little excess board beyond that needed merely to wrap around the arranged cartons.

17 Claims, 13 Drawing Figures

48
50
42
46
61
49
51
53
55
57
61
44
42
40
52
54
56
58

24
20
22
28
24
28
32
26
12

58
60
4.
62
57
34
56
34
4.
16
12
26
50
48
51
49
14
32
14
12
18
10

SLEEVE PACKAGE HAVING REVERSE TUCKED TABS FOR HOLDING MULTIPLE ASEPTIC CARTONS

CROSS-REFERENCE TO RELATED APPLICATION

This application is related to Applicant's copending application, entitled SLEEVE PACKAGE HAVING HINGED LOCKING TABS FOR HOLDING MULTIPLE ACEPTIC CARTONS, that is being filed cocurrently herewith.

FIELD OF THE INVENTION

This invention relates to a paperboard sleeve package for holding a plurality of cartons, and particularily, for holding aseptic cartons grouped together in a multi-pack arrangement.

BACKGROUND OF THE INVENTION

Aseptic cartons are commonly being used for marketing fruit juices, milk, or other liquid based food products, in quantities suited for individual servings, such as perhaps a quarter of a liter. Such cartons are formed of a paperboard material, laminated or coated with a plastic film, to be liquid-tight. Each carton is shaped somewhat as a solid block, having generally parallel opposed pairs of side and end walls, each perpendicular to the others. Like cartons are thus suited to be grouped together tightly against one another, for marketing as a multi-pack in a paperboard container or package.

One such container or package is of a generally economical wrap-around style, represented by a blank having adjacent side, top and bottom main panels hinged sucessively to one another, that are folded around the grouped cartons, and having lapped panels that are then secured together. The package is thus somewhat open-ended. The cartons are held in place within the package by small gusset panels, hinged off of the main panels of the package, that span across and partically close the open ends of the package, and that overlie part of the end cartons in the package.

The cost of the container or package is closely related to the size of the blank, and of course, the larger the blank, the more expensive the package. The blank that forms this type of open-ended but gusseted package is quite compact and small, and thus economical, as the package does not completely enclose the cartons, but leaves the end cartons at least partically exposed.

Nesting of adjacent package blanks is also important in reducing waste in the overall board requirement of the package. As only limited nesting of blanks of adjacent gusseted packages is possible, because of the small gusset panels, the effective overall blank width turns out to be virtually equal to the width of the finished container or package, plus the width of the gusset panels hinged off of the opposite sides of the main panels.

This type of package moreover requires equipment for tucking the gusset panels in place, as the blank in wrapped around the arranged cartons.

Nonetheless, the package offers stability, strength, and large side and top panels for advertising copy, and is quite popular for marketing these aceptic cartons arranged as a multi-pack.

OBJECTS OF THE INVENTION

A basic object of the present invention is to provide an improved multi-pack container or package, particularly for holding liquid-tight paperboard aceptic cartons for juices, liquid base food products, or the like, that can be more economical than the commonly used gusseted package.

The inventive package is formed from a blank that can be smaller and consequently more economical, by perhaps 10–25%, compared to the competitive gusseted packages.

Another basic object of this invention is to provide a sleeve package that can be easily formed, without gusset tucking equipment needed for the competitive gusseted packages.

A detailed object of the invention is to provide a sleeve type wrap-around package that is open-ended, to minimize board usage of the paperboard blank used for forming the sleeve, while yet having locking tab means for securely holding the cartons in place within the sleeve package.

Another detailed object of this invention is to provide tab means in the blank used to form the sleeve, the tab means being formed in a manner that does not add to the width of the blank, and further being adapted to cooperate with the cartons for holding them in the open-ended sleeve.

A specific object of this invention is to provide locking tab means of the reverse tuck configuration, being cut from but hinged relative to, interior portions of the inner lap panel, and being manipulated, as by being reverse tucked, during the formation of the sleeve package, to assume cooperative association with flap defined by end closure seam of the carton, operble to hold the cartons in the sleeve package.

SUMMARY OF THE INVENTION

To achieve these and other objects, the present invention may provide a sleeve package for holding a plurality of aceptic cartons, the package comprising a paperboard sleeve that encircles the cartons but yet is open-ended, and further having tabs, formed off of an inner lap panel, that may be manipulated to fit under or otherwise cooperate with an open flap defined by the carton end closure, operable to hold the cartons in place within the open-ended sleeve package.

A feature of this invention provides that the tabs may be cut from, and hinged relative to, the interior portion of an inner lap panel, and reverse tucked to cooperate with the flap of the carton end closure, and the outer lap panel may overlie the inner lap panel and be glued or otherwise secured to the inner panel.

The locking tabs may, in one embodiment where the end closure flap is open in a direction transverse to the open ends of the sleeve, project in the direction transverse to the open ends of the sleeve; or in another embodiment where the end closure flap is open in a direction toward an open end of the sleeve, project in the direction toward the opposite open end of the sleeve and the open flap, operable to cooperate with the carton end closure flap.

BRIEF DISCRIPTION OF THE DRAWINGS

Further objects, advantages and features of the present invention will appear from the following disclosure and description, including as a part thereof the accompanying drawings, in which.

Figure 3:
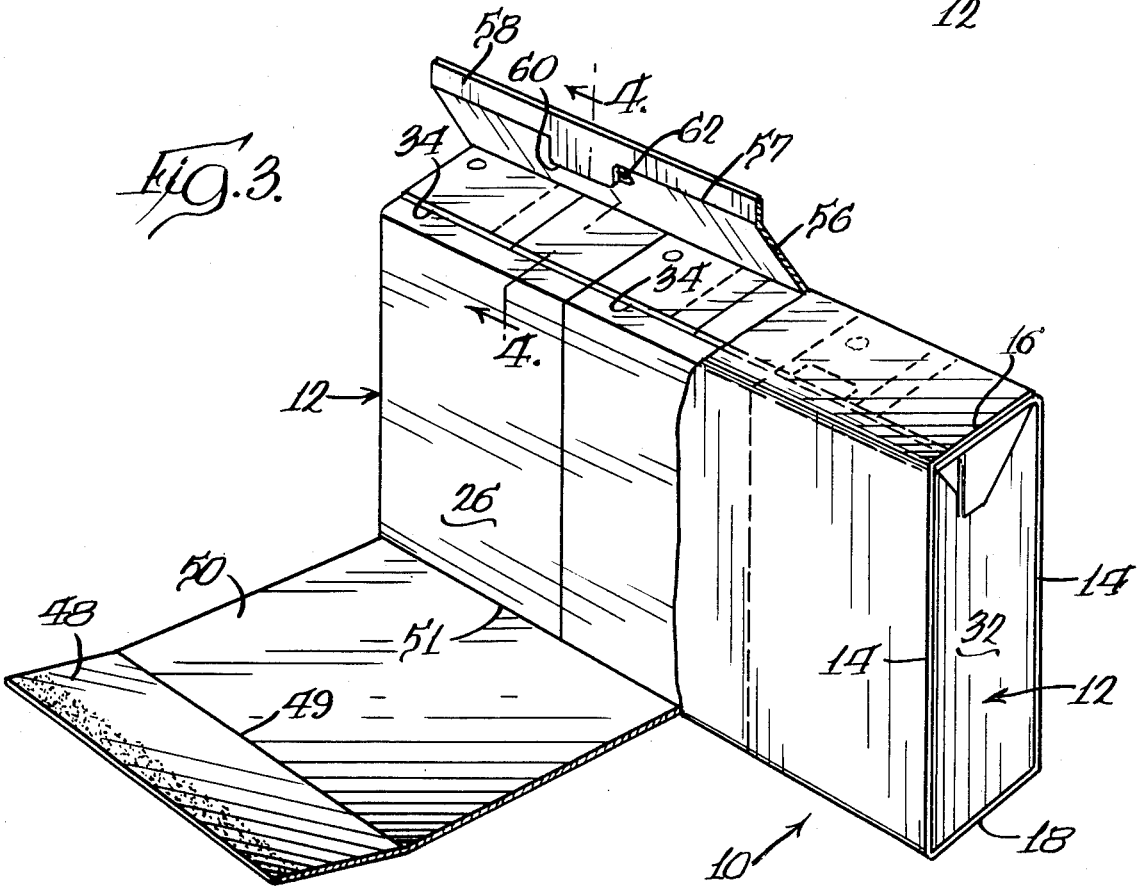
FIG. 3 is a perspective view of a row of cartons, and the blank of FIG. 1 wrapped around the cartons, to form the first embodiment of sleeve package to be disclosed herein.
Figure 4:
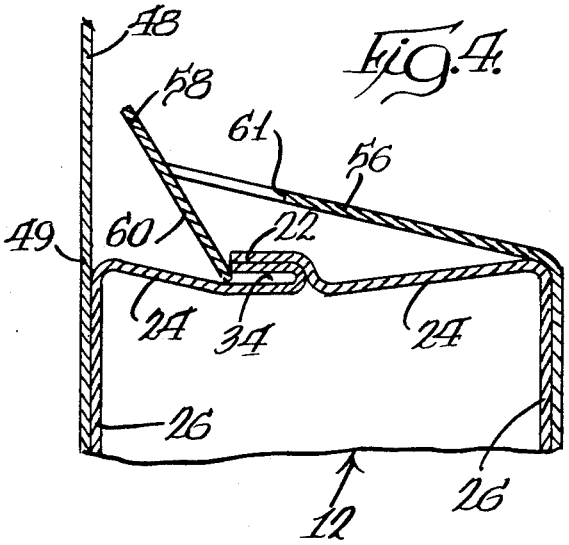
FIG. 4 is a sectional view, as seen generally from line 4—4 of FIG. 3, showing the locking tab prior to be fitted, during formation of the sleeve package, relative to the carton carried in the sleeve package.
Figure 5:
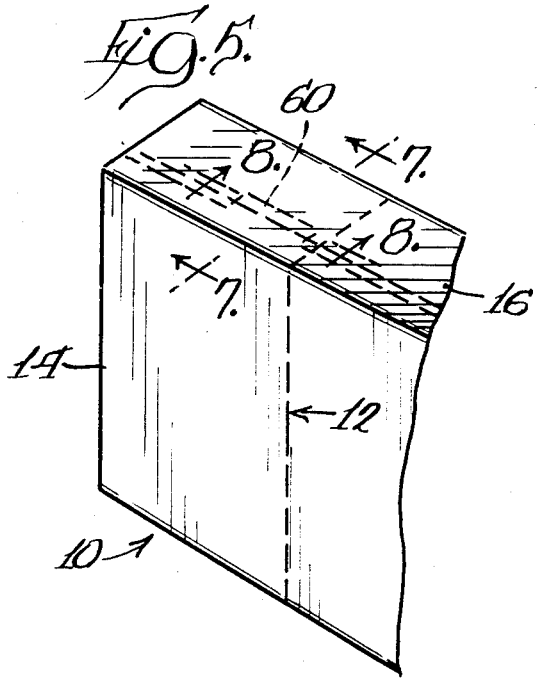
FIG. 5 is a perspective view of part of the sleeve package illustrated in FIG. 3.
Figure 6:
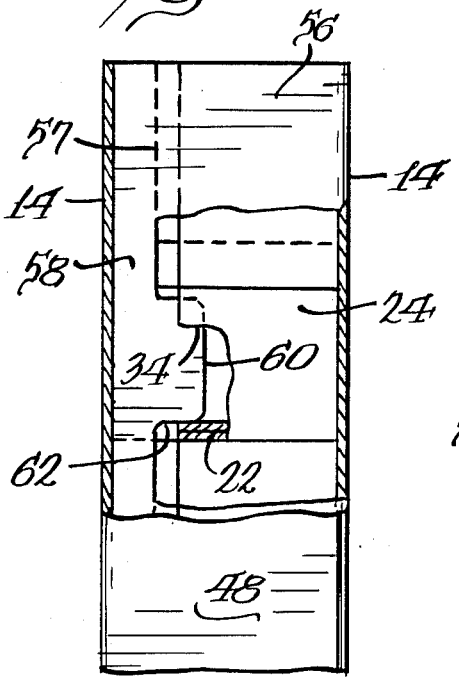
FIG. 6 is plan-type view, partly in section, showing the cooperation of the locking tab and carton illustrated in FIG. 5.
Figure 7:
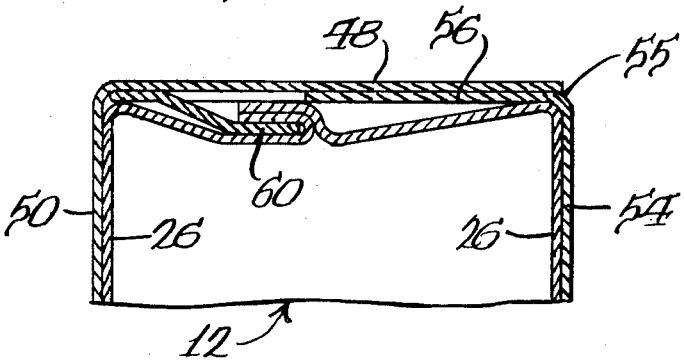
Figure 8:
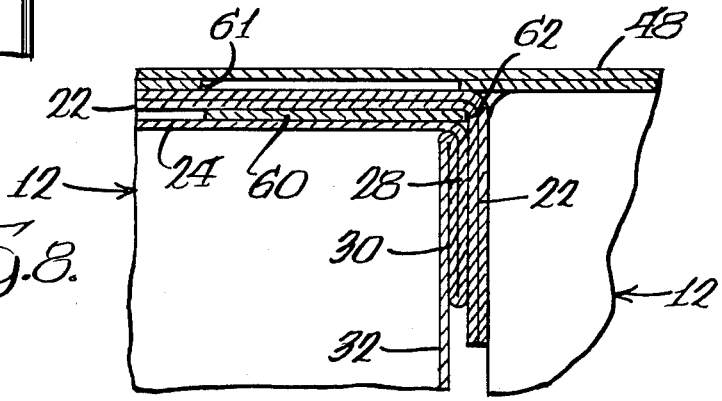
Figure 9:
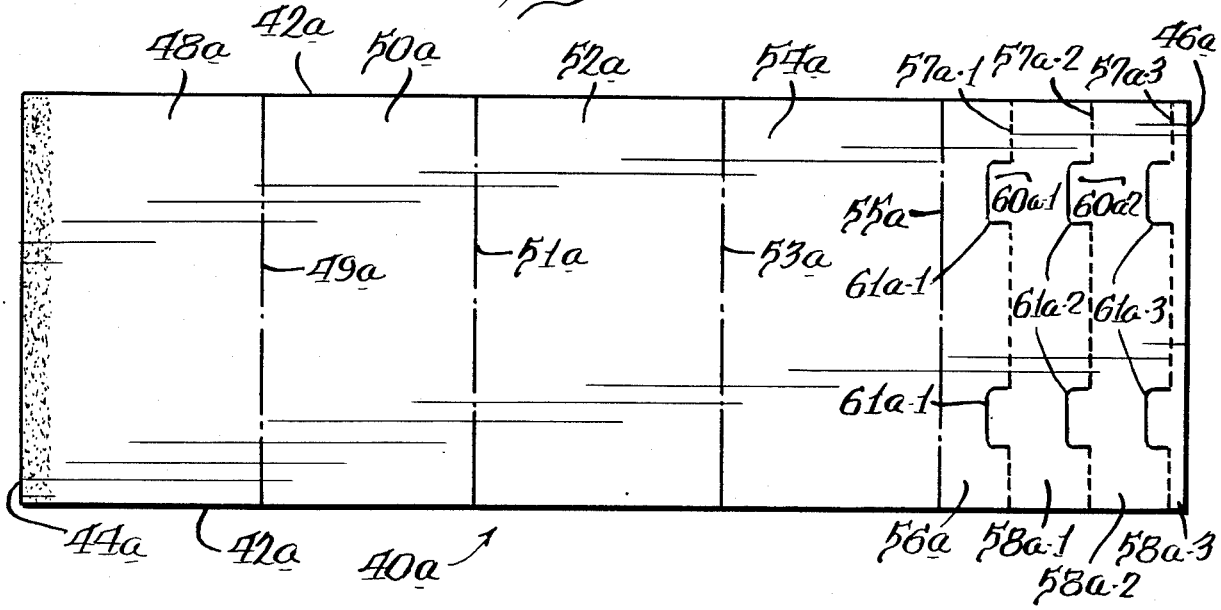
Figure 10:
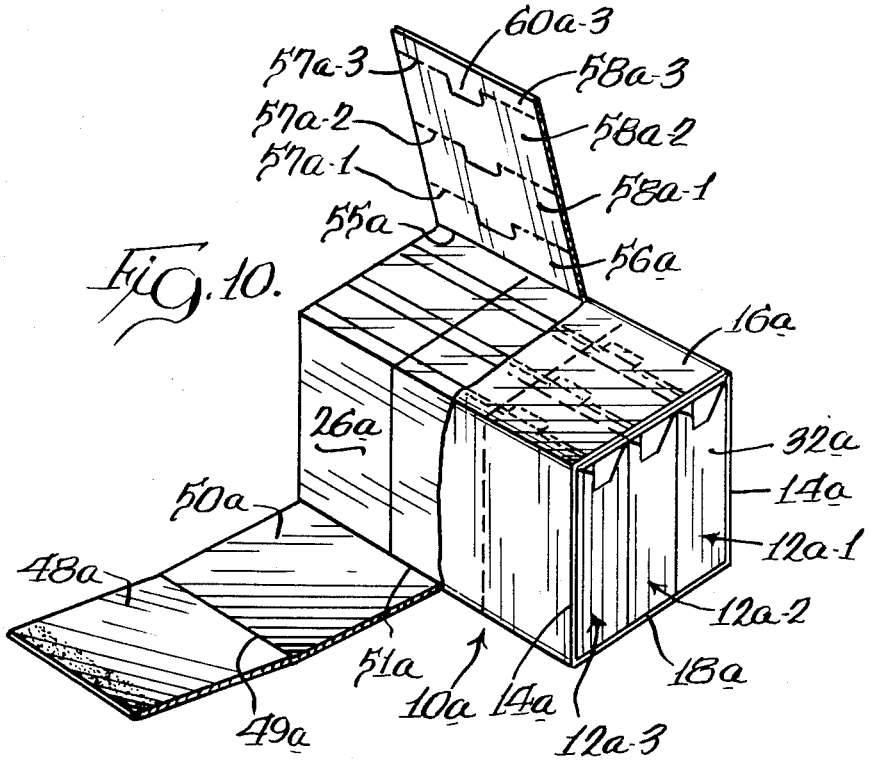
Figure 11:
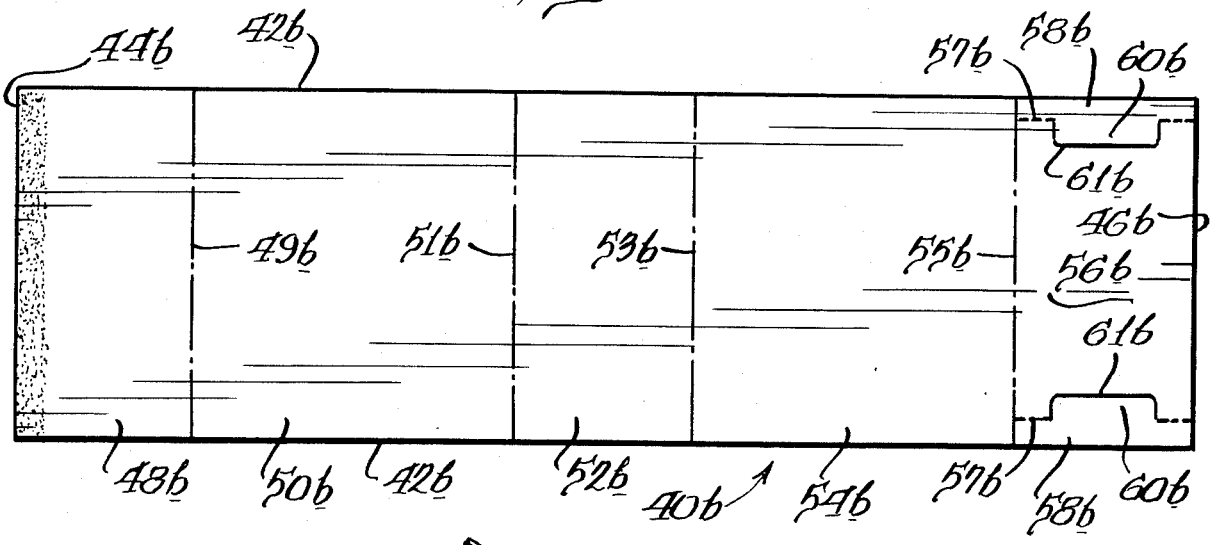
Figure 12:
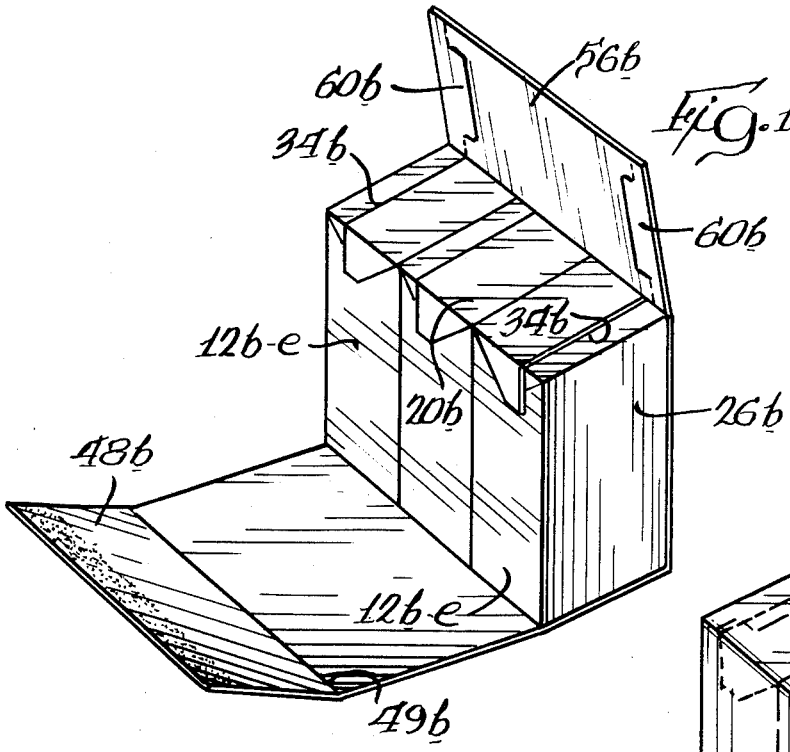
Figure 13:
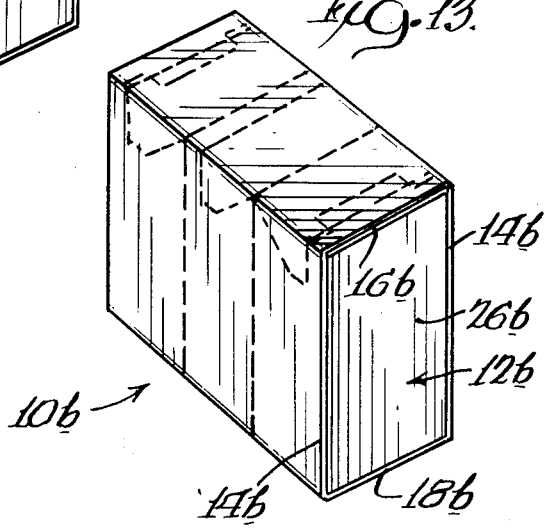

FIGS. 7 and 8 are sectional views, as seen generally from lines 7—7 and 8—8 respectively in FIG. 5, and showing the cooperation of the locking tab and carton;

FIG. 9 is a plan view of a blank used to form a second embodiment of the sleeve package, disclosed in FIG. 10;

FIG. 10 is a perspective view, similar to FIG. 3, except showing a second embodiment having three rows of cartons carried in the sleeve package, formed with the blank of FIG. 9;

FIG. 11 is a plan view of a blank used to form a third embodiment of the sleeve package, disclosed in FIGS. 12 and 13; and FIGS. 12 and 13 are perspective views, similar to FIGS. 3 and 10, except showing a third embodiment having a row of cartons arranged broadside within the sleeve package, formed with the blank of FIG. 11.

DESCRIPTION OF PREFERRED EMBODIMENTS OF THE INVENTION

The sleeve package 10 (FIG. 3), 10*a* (FIG. 10), and 10*b* (FIG. 13) to be disclosed herein, each is suited to hold a plurality of cartons 12 butted against one another across the broad and/or narrow sides of the cartons, and in a single row or in multiple rows. Where appropriate, the sleeve packages 10*a* and 10*b* will be identified by the same reference numerials used for the sleeve package 10, except with the added suffix "a" or "b". Each sleeve package 10 (or 10*a*, or 10*b*) has opposed side walls 14 (or 14*a*, or 14*b*) and opposed top and bottom walls 16 (or 16*a*, or 16*b*) and 18 (or 18*a*, or 18*b*) respectively, and otherwise has opposite open ends to expose the endmost cartons 12 in the package.

Each carton 12 is formed of a paperboard material, laminated or coated with a plastic film, to be liquid-tight; and are shaped somewhat as a solid block. Thus, each carton has generally parallel opposed pairs of side and end walls, mutally perpendicular to one another. The carton 12 is initially fabricated as an open-ended tubular element, generally rectangular in cross-section, and its opposite ends are designed to be closed and sealed by closures formed by folded and seamed sections of the tubular element itself. Each disclosed sleeve package 10 (or 10*a*, or 10*b*) has tabs that cooperate with the end closures of the endmost cartons in each row to hold the cartons in place within the open-ended sleeve package.

One form of carton end closure 20 (see FIGS. 2, 4, 6, 7 and 8) has a seam 22 that is made between main closure panels 24 hinged off of the broad side walls 26 of the carton 12, and between small triangular gusset panels 28 hinged off of the end edges of the major closure panels 24 and minor triangular panels 30 hinged off of the narrow side walls 32 of the carton. When the seam 22 is complete, the triangular gusset and minor panels 28 and 30 respectively project transverse to and outwardly beyond the narrow side walls 32 of the carton; and the seam 22 itself is oriented to lie flush against, but not be bonded to, the underlying main closure panels 24. The triangular gusset and minor panels 28 and 30 are then folded 90 degrees away from the main closure panels 24 to lie against the narrow side walls 32 of the carton; and generally, the triangular panels are bonded then in place against the side walls 32.

The seam 22, when oriented to lie against the underlying main closure panels 24, defines a flap 34 that extends across the end of the carton, from closely adjacent the narrow sides 32 of the carton, where the seam and triangular panels are folded to overlie the narrow carton sides.

Figure 1:
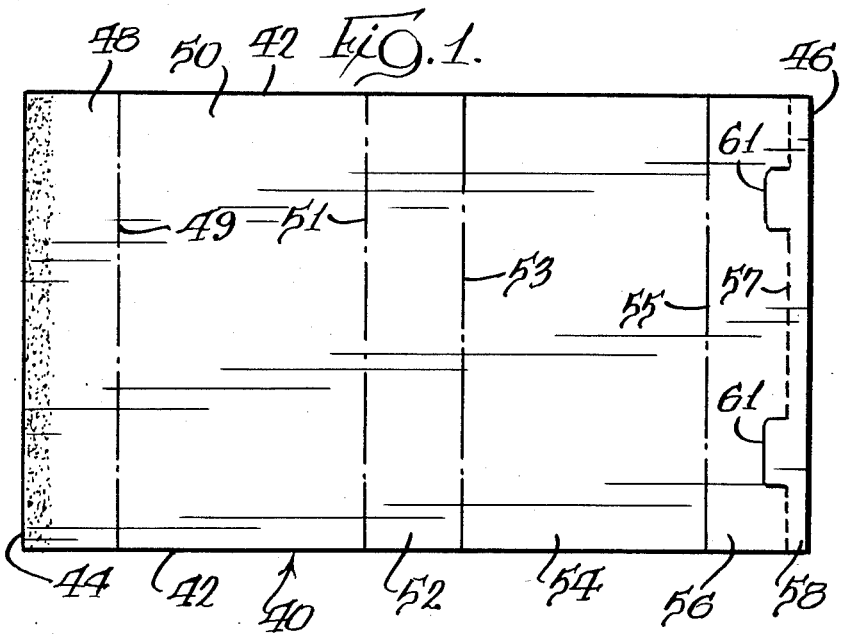
FIG. 1 is a plan view of a blank used to form a first embodiment of the sleeve package to be disclosed in FIGS. 3–8.
Figure 2:
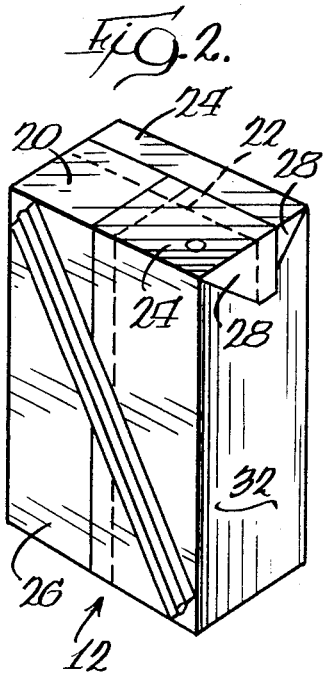
FIG. 2 is a perspective view of an aceptic carton of the type to be carried in the sleeve packages to be disclosed herein.

The sleeve package 10 is formed of a blank 40 (see FIG. 1) of paperboard, and is folded to encircle the cartons 10. The blank 40 is elongated in the direction of wrapping around the arranged cartons, and has substantially parallel side edges 42 and opposite end edges 44 and 46. The blank 40 further has substantially parallel fold or hinge lines 49, 51, 53, 55 and 57 to define sucessively hinged panels 48, 50, 52, 54, 56 and 58. Panels 50 and 54 correspond to the side walls 14 of the sleeve package; panel 52 to the bottom wall 18; and panels 56 and 58, and panel 48 to inner and outer lapped panels that together form top wall 16. As illustrated, the top carton wall 16 overlies the end closures 20 of the cartons 12.

Tabs 60 for locking the cartons in place within the open-ended sleeve package are formed from the inner lap panels 56 and 58, by cut lines 61 between the panels. The hinge line 57 may extend between the side edges 42 of the blank 40 and the end of the adjacent cut line 61, or between the adjacent ends of the adjacent cut lines. Each cut line 61 may extend in a somewhat C-shaped manner, transverse to the hinge line 57 at its ends adjacent the line, and in the direction of the line intermediate its ends. The tabs 60 are unitary with the panels 58, and project in the direction away from the adjacent free end 46 of the blank.

The tabs 60 are designed to be manipulated to fit under or otherwise cooperate with the flap 34 defined by the carton end closure 20 or seam 22. The side edge 62 of the tab, remote from the adjacent open end of the sleeve, thereby interfits with the flap as folded over the narrow side walls of the carton (see FIGS. 6 and 8) of the endmost carton, to hold the cartons in each row in place, and prevent the cartons from slipping out the open-ended sleeve package.

To form the sleeve package 10, the grouped cartons 12 are first placed on the bottom panel 52, the side panels 50 and 54 are folded against the carton sides 26, the inner pannels are brought over the top end closures 20 of the cartons, and the tab panel 58 is back-folded or reverse tucked some 15–45 degrees (see FIG. 4) relative to the plane of the adjacent hinging panel 56, to allow the tab 60 to be manipulated into proper cooperation under the seam flap 34 of the end closure 20 of the end carton. The outer end panel 48 is lapped over the inner panels 56 and 58, and the panels are bonded or otherwise secured together, as by glue strips between the inner and outer panels, generally extended across the panels between the side edges 42. The cartons are snugged tightly together as the sleeve is being formed around the arranged cartons, and while the adhesive is setting, to provide a solid package.

The sleeve package 10 is illustrated as holding three cartons 12, arranged in a single row, with the short sides of the cartons butting and facing the open ends of the sleeve. The other sleeve package 10*a* and 10*b* are similar to this, except for carrying different numbers of cartons or cartons in a different orientation.

Thus, sleeve package 10*a* is illustrated holding nine cartons, arranged in three adjacent rows 12*a*-1, 12*a*-2 and 12*a*-3 of three cartons each, with the narrow sides 32*a* of the cartons exposed at the open ends of the sleeve package. The blank 40*a* has substantially parallel side edges 42*a*, opposite end edges 44*a* and 46*a*, substantially parallel fold or hinge lines 49*a*, 51*a*, 53*a*, 55*a*, 57*a*-1, 57*a*-2 and 57*a*-3, to define sucessively hinged panels 48*a*, 50*a*, 52*a*, 54*a*, 56*a*, 58*a*-1, 58*a*-2 and 58*a*-3. Panels 50*a* and 54*a* correspond to package side walls 14*a* against the broad sides 26*a* of the cartons; panel 52*a* corresponds to the bottom wall 18*a*; and panels 56*a*, 58*a*-1, 58*a*-2 and 58*a*-3, and panel 48*a* to inner and outer lapped panels that together form top wall 16*a*. C-shaped cut lines 61*a*-1, 61*a*-2 and 61*a*-3 extend off the hinge lines 57*a*-1, 57*a*-2 and 57*a*-3 to define three rows of locking tabs 60*a*-1, 60*a*-2 and 60*a*-3.

The inner lap panels, and package wall 16*a*, again overlie each row of cartons. The tabs may be interlocked with the end cartons in each row, with tabs 60*a*-1 first being manipulated to fit under the cartons in the adjacent first row 12*a*-1, with tabs 60*a*-2 then being manipulated to fit under cartons in the middle row 12*a*-2, and with the tabs 60*a*-3 lastly being manipulated to fit under the cartons in the last row 12*a*-3. The outer lap panel 48*a* preferably overlies each of the inner panels 56*a*, 58*a*-1, 58*a*-2 and 58*a*-3, and can be secured thereto as by glue strips between the panels, typically extended between the side edges of the panels.

The sleeve package 10*b* is also illustrated as holding three cartons 12*b* arranged in a single row, but with the broad sides 26*b* of the cartons being exposed at the open ends of the sleeve. The end cartons 12*b*–*e* are rotated 180 degrees relative to one another, to have each end closure flap 34*b* open toward the adjacent open end of the sleeve. The blank 40*b* has substantially parallel side edges 42*a*, opposite end edges 44*b* and 46*b*, and substantially parallel fold lines 49*b*, 51*b*, 53*b* and 55*b* to define sucessively hinged panels 48*b*, 50*b*, 52*b*, 54*b* and 56*b*. Tab panels 58*b* are hinged, on fold lines 57*b* extended transverse to the other fold lines, to inner panel 56*b*; and tabs 60*b* are formed from inner panel 56*b*, by c-shaped cut lines 61*b* off of the fold lines 57*b*. The tabs 60*b* project toward one another, or away from the side edges 42*b* of the blank 40*b* or the open ends of the sleeve package. Panels 50*b* and 54*b* correspond to package side walls 14*b*; panel 52*b* corresponds to the bottom wall 18*b*; and panels 56*b* and 58*b*, and 48*b* correspond to inner and outer lapped panels, that together form top wall 16*b*. The inner lap panel again overlies the carton end closures 20*b*.

To set up the sleeve package 10*b*, the tabs 60*b* may be manipulated to fit under the closure seam flap 34*b*, in a progressive manner, as the inner panel 56*b* is being moved against the underlying carton end closures 20*b*, and as the tabs are folded relative to the adjacent hinging panel 56*b* so as to point the free tab edge downwardly toward the open flap. The outer panel 48*b* may then be secured, as by beads of adhesive or the like, to the inner panels 56*b* and 58*b*.

The disclosed sleeve package 10 (or 10*a*, or 10*b*) may be more economical than the conventional gusseted package, by perhaps 10–25%. This is possible as the opposite side edges of the blank need extend only to the end of the package, or the end of the end cartons carried therein, and no locking gusset panels are required off these edges to add the the blank width. In fact, the opposite side edges 42 (or 42*a*) of the blank can even be shy or shortened compared to the side edge of the end-most cartons carried in the sleeve package, and the end carton may project beyond the side edge of the blank. The added board needed to define the lapping inner and outer panels is only off the short edge of the blank, to add little to the board requirement. Moreover, as the blank shape may rectangular in plan, very good nesting of adjacent blanks may be possible to provide for exceptional board economy.

Although the aseptic cartons 12 are now being used for marketing fruit juices, milk, or other liquid base products in quantities suited for individual servings, such as perhaps a quarter of a liter; such usage does not limit either the size, or product, which may potentially be used or carried. The invention is therefore intended to be limited only by the scope of the claims hereinafter following.

What is claimed is:

1. A sleeve package for holding a plurality of aceptic cartons in a row, the combination of each carton being of a block shape having opposed pairs of side walls and a pair of end walls, and the walls of each of such pairs being tranverse to the others, one of the end walls of each carton comprising an end closure having a main panel and an overlapping flap, a paperboard blank formed with adjacent panels, hinged to one another across spaced fold lines, the panels including at least one main panel and inner and outer lap panels, said blank being adapted to be wrapped around the cartons, with the lap panels secured together, to define a sleeve having a pair of open ends, said cartons being in the sleeve with the row aligned with the open ends of the sleeve, the cartons at the opposite ends of the row being exposed out the open ends of the sleeve, a tab formed on the inner lap panel adjacent one of the exposed end cartons, said tab being shaped to underlie and cooperate with the flap of the one end wall of said one end carton, so as to hold said one end carton in the sleeve.

2. A sleeve package for holding a plurality of aceptic cartons, according to the combination of claim 1, wherein further the end closure main panel and flap of said one end wall define a space that is open transverse to the direction of the row, and wherein the tab on the inner lap panel is shaped to project in a direction transverse to the open end of the sleeve, toward and into the space underlying the flap.

3. A sleeve package for holding a plurality of aceptic cartons, according to the combination of claim 1, wherein further the end closure main panel and flap of said one end wall define a space that is open in the direction of the row and toward the adjacent open end of the sleeve, and wherein the tab on the inner lap panel is shaped to project in a direction away from said adjacent open end of the sleeve, toward and into the space underlying the flap.

4. A sleeve package for holding a plurality of aceptic cartons, according to the combination of claim 1, wherein further the tab on the inner panel, is formed by a curved cut line through the panel.

5. A sleeve package for holding a plurality of aceptic cartons, according to the combination of claim 4, wherein further the cut line is C-shaped, and wherein further the inner panel has a hinge line extended outwardly away from each end of the cut line and toward adjacent edges of the inner panel.

6. A sleeve package for holding a plurality of aceptic cartons, according to the combination of claim 5, wherein the fold lines between the panels of the blank and said hinge line on the inner panel are extended substantially parallel to one another.

7. A sleeve package for holding a plurality of aceptic cartons, according to the combination of claim 5, wherein the fold lines between the panels of the blank are extended substantially parallel to one another, and said hinge line is extended transverse to the fold lines.

8. A sleeve package for holding a plurality of aceptic cartons, according to the combination of claim 1, further including said cartons being arranged in a number of adjacent rows, each row being extended between the open ends of the sleeve and having opposite end cartons exposed out the open ends of the sleeve, and a plurality of tabs formed on the inner pannel, each such tab being shaped and located to line up adjacent a respective end carton of each row, and to underlie and cooperate with the flap of the one end wall of said respective end carton, so as to hold said cartons in the sleeve.

9. A sleeve package for holding a plurality of aceptic cartons, according to the combination of claim 8, wherein further each tab on the inner panel, is formed by a C-shaped cut line through the panel, and the inner panel has a hinge line extended outwardly away from each end of the cut line and toward adjacent edges of the inner panel.

10. A sleeve package for holding a plurality of aceptic cartons, according to the combination of claim 1, further including the end closure main panel and flap of each one end wall defining a space open only toward one of the side walls of the carton, said cartons being arranged with the opposite end cartons of the row being rotated 180 degrees relative to one another, to provide that the space defined between each end closure main panel and flap opens toward the adjacent open end of the sleeve, a plurality of such tabs formed on the inner panel, and each of said tabs being shaped and located to project in the direction away from the adjacent open end of the sleeve and to fit into said space defined between each end closure main panel, and under said flap of each end carton of the row.

11. A sleeve package for holding a plurality of aceptic cartons in a row, the combination of each carton being of a block shape having opposed pairs of side walls and a pair of end walls, and the walls of each of such pairs being mutually perpendicular to one another, one end wall of each carton comprising an end closure having a main panel and an overlapping flap that defines a space therebetween open toward one carton side wall, a paperboard blank formed with adjacent panels, hinged to one another across spaced respective substantially parallel fold lines, the panels including at least one main panel and inner and outer lap panels, said blank being adapted to be wrapped around the cartons, with the lap panels secured together and overlapping the one end wall of each carton, to define a sleeve having a pair of open ends, said cartons being in the sleeve with the row aligned with the open ends of the sleeve, the cartons at the opposite ends of the row being exposed out the open ends of the sleeve, a plurality of tabs formed on the inner lap panel, each tab being adjacent one of the exposed end cartons, each said tab being defined by a C-shaped cut line through the inner lap panel, a hinge line extended outwardly from each end of the cut line and toward a respective adjacent edge of the inner panel, each said tab projecting toward and into the space between the end closure main panel and flap of the adjacent end carton, and being shaped and located to underlie and cooperate with said flap, each said tab being manipulated, by reverse folding the inner panel about said hinge line, during the formation of the blank around the cartons, to underlie said flap and hold the cartons in the sleeve package.

12. A sleeve package for holding a plurality of aceptic cartons, according to the combination of claim 11, wherein further the defined space underlying said flap of each exposed end carton being open transverse to the row, said hinge line being extended substantially parallel to the fold lines between the main panels of the blank, and each tab being shaped to project transverse to the open ends of the sleeve and toward and into the defined space underlying said flap.

13. A sleeve package for holding a plurality of aceptic cartons, according to the combination of claim 12, further including said cartons being arranged in a number of adjacent rows extended between the open ends of the sleeve, and said tabs being defined on the inner panel and located respectively to line up adjacent each end carton of each row, and to underlie and cooperate with the flap of said end carton, so as to hold said cartons in the sleeve.

14. A sleeve package for holding a plurality of aceptic cartons, according to the combination of claim 11, wherein further the defined space underlying said flap of each of said end cartons being open in the direction of the row outwardly of the sleeve, each said hinge line for each of said tabs being extended substantially transverse to the fold lines between the main panels of the blank, and each of said tabs being shaped and located to project inwardly away from the adjacent open end of the sleeve and into said defined space and under said flap of the respective end carton.

15. In combination, a plurality of aceptic cartons each being of a block shape and having opposed pairs of side walls and a pair of end walls, one end wall of each carton comprising an end closure having a main panel and a seam that lies as a flap next to the main panel and defines therewith a space open toward one of the carton side walls, a paperboard blank formed with adjacent panels, hinged to one another across spaced fold lines, the panels including at least one main panel and inner and outer lap panels, said blank being adapted to be wrapped around the cartons, with the lap panels being secured together and overlying the one end wall of the each carton, to define a sleeve having a pair of open ends, said cartons in the sleeve defining at leaast one row aligned with the open ends of the sleeve, the cartons at the opposite ends in each row being exposed out the open ends of the sleeve, a plurality of tabs formed on the inner lap panel, each tab respectively being adjacent each exposed end cartons of each row, each tab being defined by a C-shaped cut line through the inner lap panel and projecting toward the open space defined by the flap of the adjacent exposed end carton, and being shaped to underlie and cooperate with the flap, and hold the cartons in the sleeve package.

16. The combination claimed in claim 15, wherein each tab is further defined by a straight hinge line extended from each end of the cut line toward a respective adjacent edge of the inner panel, the spaced fold lines of the blank being substantially parallel to one another, and the hinge line of each tab being substantially parallel to the fold lines of the blank.

17. The combination claimed in claim 15, wherein each tab is further defined by a straight hinge line extended from each end of the cut line toward a respective adjacent edge of the inner panel, the spaced fold lines of the blank being substantially parallel to one antoher, and the hinge line of each tab being substantially normal to the fold lines of the blank.

* * * * *